United States Patent [19]

Inoue et al.

[11] Patent Number: 4,834,246

[45] Date of Patent: May 30, 1989

[54] TONER CARTRIDGE

[75] Inventors: Yoshio Inoue; Haruo Furuta, both of Kanagawa, Japan

[73] Assignee: Fuji Xerox Co., Ltd., Tokyo, Japan

[21] Appl. No.: 174,433

[22] Filed: Mar. 28, 1988

[30] Foreign Application Priority Data

Mar. 31, 1987 [JP] Japan ..... 62-76021

[51] Int. Cl.[4] ..... B43M 7/00; B65D 3/26

[52] U.S. Cl. ..... 206/631; 206/601; 220/258

[58] Field of Search ..... 206/384, 620, 629, 634, 206/601; 220/254, 256, 257, 258

[56] References Cited

U.S. PATENT DOCUMENTS 4,401,229 8/1983 Bell et al. ..... 220/258
4,448,345 5/1984 Helms ..... 220/258
4,466,553 8/1984 Zenger ..... 220/258
4,533,064 8/1985 Kawamata et al. ..... 220/258
4,535,889 8/1985 Terauds .

*Primary Examiner*—Joseph Man-Fu Moy
*Attorney, Agent, or Firm*—Finnegan, Henderson, Farabow, Garrett, & Dunner

[57] ABSTRACT

A disposable toner cartridge includes a cartridge container having a bottom opening for discharging toner and a sealing film that may be peeled off of the bottom opening in a first direction. A covering member is attached to the cartridge container beneath the sealing film and engages the sealing film such that movement of the covering member in a first direction seals the sealing film from the bottom opening and in a second direction reseals the bottom opening with the sealing film.

9 Claims, 5 Drawing Sheets

TONER CARTRIDGE

FIELD OF THE INVENTION

The present invention relates to a toner cartridge, which is detachably mounted onto a toner box, and particularly relates to an improvement in a toner cartridge using a sealing film arranged to open and close an opening of a toner container of the cartridge.

BACKGROUND OF THE INVENTION

It has been known to mount a toner cartridge onto a toner box having a slit-like opening formed in a peripheral wall of a cylindrical cartridge container. A sealing film is removably attached to the slit-like opening. With this construction, the cartridge container can be set into a toner box after peeling the sealing film off. Another toner cartridge has been arranged such that a toner supply opening is formed in the top portion of a cartridge container and a covering member is provided to close the toner supply opening. The cartridge container is set into a toner box after peeling the sealing film off and then the toner cartridge is rotated by 180 degrees for the purpose of toner supply.

Such toner cartridges have experienced the problem of environmental pollution in that toner scatters when the toner cartridges are attached because it is necessary to open the toner cartridge before it is attached in the toner box. To solve this problem, there has been proposed a toner cartridge in Japanese Unexamined Patent Publication No. 58-224364. As shown in FIG. 14, the toner cartridge has an opening 2 formed in the lower portion of a substantially rectangular-parallelepiped cartridge container 1 for the purpose of toner supply. A sealing film 3 having a length about twice the width of the opening 2 is formed with one end fixed onto one longitudinal side edge of the opening 2. The other end of the sealing film 3*a* is turned back at an area facing the opening 2 and is fixed to the first end of the sealing film 3 or onto the one side edge of the opening 2 near the first end to form a loop. A covering member 4 is attached within the loop of the sealing film 3 so that the covering member 4 is slidable along the lower side of the cartridge container 1.

According to the toner cartridge of this type, when toner is to be supplied the covering member 4 is first positioned in the closed position shown by the solid line and then slid in the direction of the arrow A after the toner cartridge has been mounted onto a toner-receiving opening (not shown) of a toner box 5. In this condition, the covering member 4 peels the loop-like sealing film 3 off from the edge of the opening 2 with the movement of the covering member 4, so that the opening 2 is opened to supply toner into the toner box 5 from the cartridge container 1 without scattering.

When the toner cartridge 1 is to be removed from the toner box, the covering member 4 is first slid in the direction of the arrow B to close the opening 2. The covering member 4 acts on the loop-like sealing film 3 so that the sealing film 3 follows the movement of the covering member 4 to close the opening 2 securely. Accordingly, in removing the toner cartridge from the toner box, the problem that toner remaining within the toner cartridge scatters to the surroundings thereof can be effectively avoided.

In the aforementioned conventional toner cartridge, when the covering member 4 is slid in the direction of the arrow A to open the cartridge container 1, the end edge of the covering member 4 collides with the loop-like sealing film 3. Because the turnedback portion 3*a* of the loop-like sealing film 3 and the film attaching portion thereof at the peeling-off start point serve as static points, instantaneous hypertonic force T acts on the sealing film 2. Frictional resistance at the contacting portion between the end of the covering member 4 and the sealing film 3 increases according to the hypertonic force T. The movement resistance of the covering member 4 increases by the frictional resistance, and the operational force of the covering member 4 becomes high.

To overcome such a problem, the edge of the covering member 4 may be formed as an arc or be provided with pulleys 4*a* to reduce the frictional resistance at the contacting portion between the covering member 4 and the sealing film 3. Such structure, however, merely reduces the frictional resistance by the reduction of the frictional coefficient at the contacting portion on the side of the covering member 4. In short, the problem is not completely solved and other problems arise in that the edge portion of the covering member 4 and the attaching points of the sealing film 3 are complicated in construction. Consequently, the toner cartridge cannot be produced at a low cost, which is necesary since the toner cartridge must be disposable.

SUMMARY OF THE INVENTION

An object of the present invention is to solve the above problems in the prior art.

Another object of the present invention is a toner cartridge that makes it easy to open and close the open end of a cartridge container.

A further object of the present invention is a toner cartridge that may be produced as a low-cost, disposable item.

These and other objects are achieved by a disposable toner supply cartridge to be detachably mounted over a toner-receiving opening of a toner box comprising a cartridge container for holding the toner, the cartridge container having a bottom opening; a sealing film for sealing the bottom opening formed in the bottom of the cartridge container, the sealing film being adapted to be peeled off from the bottom opening; and a covering member attached to the cartridge container beneath the sealing film, the covering member being slidable in a first direction corresponding to the direction in which the sealing film is to be peeled off from the bottom opening, the sealing film having a first end fixedly attached to an edge portion of the bottom opening and a second end integrally provided with a bent extension covering at least one end of the covering member such that sliding of the covering member in the first direction moves the bent extension of the sealing film in the first direction to cause the sealing film to be peeled from the bottom of the cartridge container to expose the bottom opening of the cartridge container.

BRIEF DESCRIPTION OF THE DRAWINGS

The manner by which the above objects, and other objects, features, and advantages of the present invention are attained will be apparent from the following description when considered in connection with the accompanying drawings, wherein.

DETAILED DESCRIPTION

Figure 1:
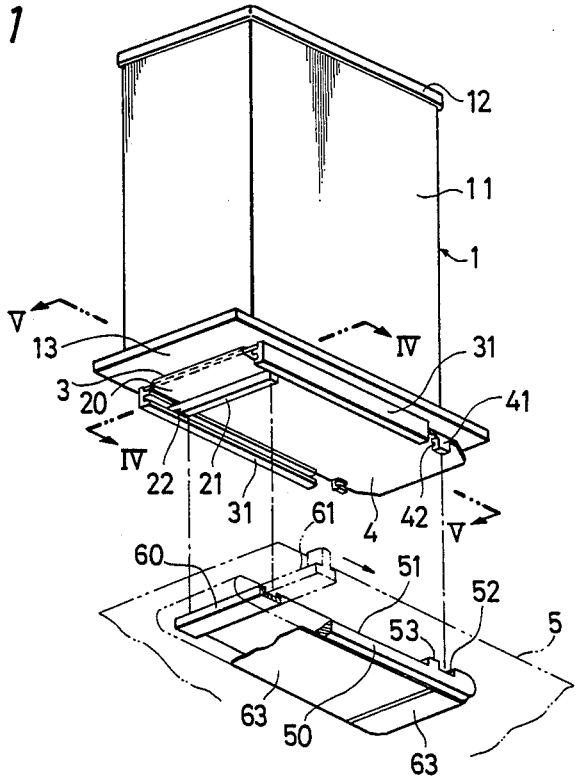
FIG. 1 is a perspective view showing a first embodiment of the toner cartridge according to the present invention and the opening and closing operation mechanism thereof.
Figure 2:
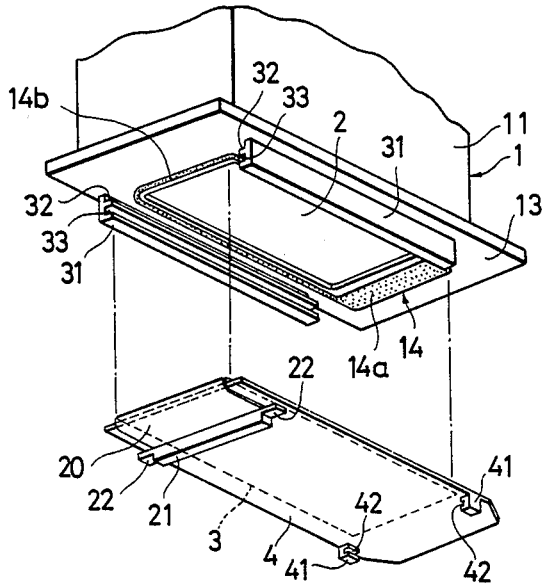
FIG. 2 is an exploded perspective view showing in detail the toner cartridge of the embodiment of FIG. 1.
Figure 3:
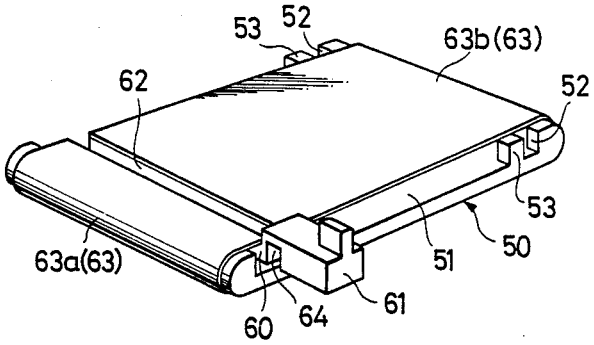
FIG. 3 is a perspective view showing in detail the opening and closing operation mechanism of the embodiment of FIG. 1.
Figure 4:
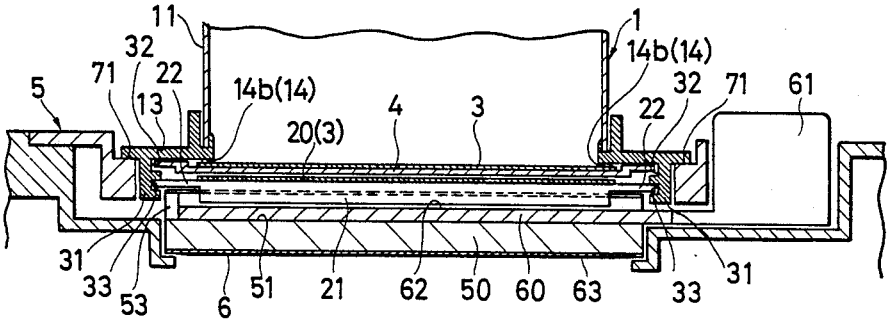
FIGS. 4 and 5 are sectional views taken on the line IV—IV and line V—V of FIG. 1, respectively.
Figure 5:
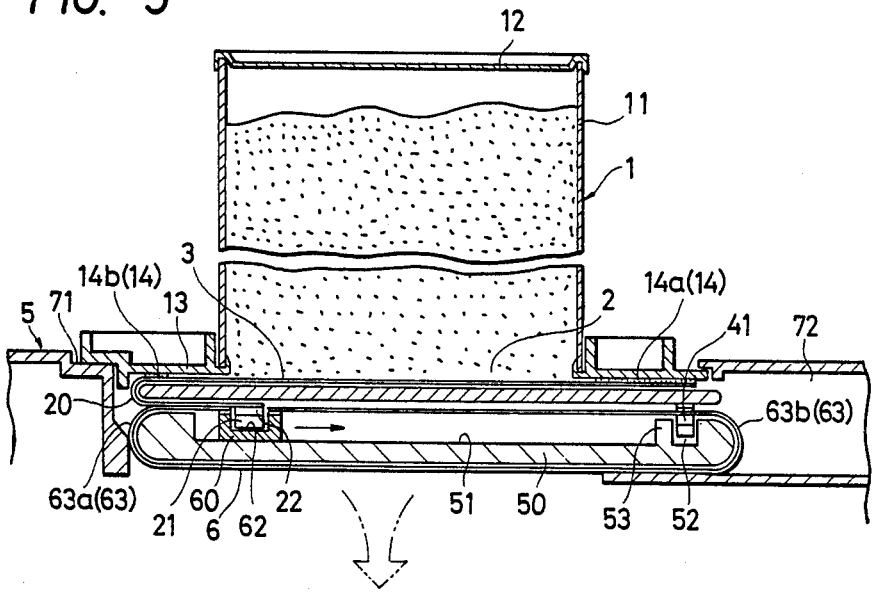

The toner cartridge of the present invention is made to be detachably mounted onto a toner-receiving opening of a toner box for the purpose of toner supply. A cartridge container containing toner includes a sealing film for sealing a bottom opening formed in the cartridge container. The sealing film may be peeled off from the bottom opening by a covering member attached to the cartridge container at the underside of the sealing film. One end of the sealing film is fixedly attached to an edge portion of the bottom opening, and the sealing film includes an integral bent extension at the other end to cover at least one end of the covering member in the direction in which the covering member slides. By moving a selected one of the bent extension and the covering member, the sealing film and the covering member move together to close/open the bottom opening of the cartridge container.

Although it is sufficient that the integral, bent extension is formed at least to cover the end of the covering member because the bent extension is required to follow the covering member at the time of opening, the bent extension may be further extended along the bottom surface of the covering member. It is preferable that the area of the sealing film that is exposed to the bottom surface of the covering member be reduced to prevent the accidental breakdown of the sealing film. Further, in order to move either one of the bent extension of the sealing film and the covering member, it is necessary that an operation member engaged with the bent extension and the covering member be provided at the toner-receiving opening of the toner box. The operation member may be provided integrally with the box-side covering member for opening and closing the toner-receiving opening of the toner box or may be provided separately from the box-side covering member. The specific construction of the operation member may, of course, be modified in various ways.

For opening and closing the opening of the cartridge container, the sealing film and the covering member may be arranged to follow each other while the cartridge container is fixed to the toner box. Alternatively, the sealing film and the covering member may be arranged to follow each other while the cartridge container is moved relative to the toner box. Particularly in the case where the cartridge container is moved, the toner-receiving opening can be established to be about twice as large as the size of the opening of the cartridge container to make it possible to supply toner uniformly along the toner-receiving opening. This is preferable when it is required to enlarge the area of toner supply.

According to the aforementioned technical means, the bent extension of the sealing film can be moved relative to the cartridge to engage the end of the covering member when the cartridge container is to be opened. In this condition, the sealing film is successively peeled off from the edge of the opening. Even when the bent extension is in contact with the end of the covering member, no hypertonic force acting on the sealing film arises because the bent extension is moved directly. Accordingly, frictional resistance between the two can be made very small so that the covering member moves smoothly to the opening position with the movement of the bent extension.

In the case where the opening of the cartridge container is to be closed, the covering member will be in the open position and can be moved in reverse relative to the cartridge container to make the bent extension of the sealing film engage the end of the covering member. In this condition, the covering member moves to close the opening of the cartridge container and, at the same time, the sealing film follows the covering member to close the opening.

As shown in FIGS. 1 through 5, the toner cartridge basically comprises a substantially rectangular-parallelepiped cartridge container 1, a sealing film 3 for removably sealing an opening 2 formed in the bottom of the cartridge container 1, and a covering member 4 attached to the cartridge container 1 at the underside of the sealing film 3 so as to be slidable in the direction in which the sealing film 3 is to be peeled off from the opening 2.

The cartridge container 1 is formed of a suitable material such as paper, plastic, or the like. The cartridge container 1 is constituted by a rectangular-parallelepiped body 11, a top plate 12 for blocking an upper opening of the rectangular-parallelepiped body 11, and a body plate 13 for blocking a lower opening of the rectangular-parallelepiped body 11. A slit-like opening 2 for toner supply is formed in the bottom plate 13. A sealing agent 14 is provided on the edge of the opening 2 of the bottom plate 13. The sealing agent 14 has a plane adhesive portion 14*a* having a large area disposed in a position adjacent to one longitudinal edge of the opening 2, and linear adhesive portions 14*b* disposed around the other edges of the opening 2. When the sealing film 3 is stuck to the edges of the opening 2 with the sealing agent 14, the adhesive portion 14*a* permanently attaches one end of the sealing film 3. The linear adhesive portion 14*b* functions as a temporary attaching portion suitable for removably securing the sealing film 3.

The end of the sealing film 3 opposite to the end attached to the adhesive portion 14*a* is provided with a U-shaped bent extension 20 covering one end of the covering member 4 and projecting slightly along the bottom surface of the covering member 4. A stopping-/engagement projecting-bar member 21 is fixed along the end edge of the bent extension 20. Guiding protrusions 22 project outwardly at the opposite ends of the stopping/engagement projecting-bar member 21.

A pair of guide rails 31 are fixed at the widthwise opposite ends of the opening 2 in the bottom plate 13. Each guide rail 31 is provided with two grooves 32 and 33. The covering member 4 is slidably fitted in the grooves 32. The ends of the guiding protrusions 22 of the stopping/engagement projecting-bar member 21 are slidably fitted in the grooves 33. A pair of stopping/engagement protrusions 41 are formed at the widthwise opposite ends of the front surface of a projecting portion of the covering member 4. Each stopping/engagement protrusion 41 is provided with a groove 42 formed on an extension of the line of the groove 33.

A toner-receiving opening 6 is provided in the toner box 5 corresponding to the opening 2 of the cartridge container 1. The toner-receiving opening 6 is opened and closed by a box-side covering member 50. A retracted portion 51 opened in the widthwise direction of the box-side covering member 50 is formed in the front surface of the box-side covering member 50. A movable member 60 is disposed in the retracted portion 51 so as to be movable along the longitudinal direction of the retracted portion 51. The movable member 60 has an operation knob 61 projecting from one end, and a stopping/engagement U-shaped groove 62 for receiving the stopping/engagement projecting-bar member 21. A pair of stopping/engagement grooves 52 are formed at the widthwise opposite ends of the retracted portion 51 of the boxside covering member 50 for receiving the stopping/engagement protrusions 41 provided on the toner-cartridge-side covering member 4.

The opposite ends of the boxside covering member 50 are shaped so as to be arcuate, and an end of each of a pair of films 63 (more specifically, 63*a* and 63*b*) is caught in the stopping/engagement U-shaped groove 62 of the movable member 60. The films 63 are turned down to the rear surface of the box-side covering member 50 through the edge of the box-side covering member 50, respectively. The other ends of the respective films 63 are fixed in the vicinity of the longitudinal edge portion of the toner-receiving opening 6. In short, each film 63 is shaped like a loop. The operation knob 62 of the movable member 60 is provided with an interference-prevention hole 64 for preventing interference with the partition walls 53 of the stopping/engagement grooves 52.

A container setting shelf 71 and a housing concavity 72 are formed near the toner-receiving opening 6 of the toner box 5. The container setting shelf 71 is arranged to support the cartridge container 1, and the housing concavity 72 is arranged to house the covering members 4 and 50 when the covering members 4 and 50 moved to the open position.

Figure 6:
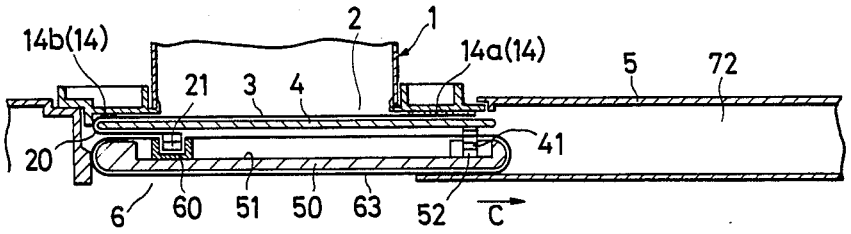
FIGS. 6, 7 and 8 are sectional views similar to FIG. 5, showing the process of toner supply.
Figure 7:
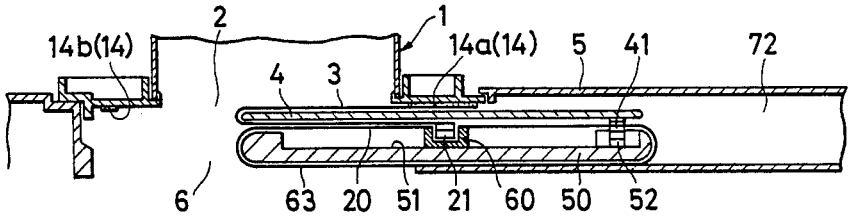

When toner is to be supplied into the toner box 5, the cartridge container 1 is mounted on the container setting shelf 71 as shown in FIG. 6, and then the movable member 60 is moved in the direction of the arrow C. At that time, when the cartridge container 1 has been set in a predetermined position, the stopping/engagement projecting-bar member 21 provided at the end edge of the bent extension 20 is fitted into the stopping/engagement U-shaped groove 62 of the movable member 60. At the same time, the stopping/engagement protrusions 41 of the covering member 4 are fitted into the stopping/engagement grooves 52 of the box-side covering member 50. In this condition, when the movable member 60 is slid in the direction of the arrow C, the stopping/engagement projecting-bar member 21 is drawn in the direction of the arrow C so that the detachable portion of the sealing film 3 is successively peeled off in the direction of the arrow C through the bent extension 20 as shown in FIG. 7. At the same time, the covering member 4 moves in the direction of the arrow C.

The bent extension 20 contacts the end of the covering member 4, but there is no hypertonic force acting on the bent extension 20 because the covering member 4 does not serve as a member for preventing the movement of the bent extension 20. Accordingly, frictional resistance at the contact point between the bent extension 20 and the end of the covering member 4 is kept low to prevent the operational force of the movable member 60 from becoming very heavy at the start of the peeling-off of the sealing film 3.

In this embodiment, the operation knob 61 opens and closes the box-side covering member 50. More specifically, when the movable member 60 is moved by sliding the operation knob 61, the films 63 move with the movable member 60 so that the box-side covering member 50 moves in the direction of the arrow C at a rate of half of one stroke of the movable member 60..

Figure 8:
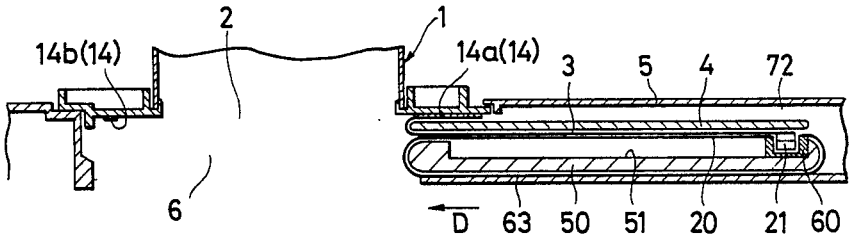

When the movable member 60 is moved about twice the length of the opening 2 based on the aforementioned operational principle, as shown in FIG. 8, the sealing film 3 is completely peeled off from the detachable portion 14*b* and the covering member 4 follows the sealing film 3 to move to the opening position within the housing concavity 72. At the same time, the box-side covering member 50 moves into the housing concavity 72, so that the toner-receiving opening 6 is completely opened. During this procedure, toner is successively fed into the toner box 5 through a connecting portion between the opening 2 and the opening 6.

When the toner cartridge (presumably empty) is to be removed, the movable member 60 is moved in the direction of the arrow D from the opening position of FIG. 8 to the closing position of FIG. 6, and then the toner cartridge may be removed from the toner box 5.

When the movable member under the condition is moved in the direction of the arrow D from the open position, the films 63 move with the movable member 60 so that the box-side covering member 50 starts moving to close the toner-receiving opening 6. In this condition, the stopping/engagement grooves 52 of the covering member 50 are fitted to the stopping/protrusions 41 of the cartridge-side covering member 4. Accordingly, the cartridge-side covering member 4 follows the box-side covering member 50 and moves to close the opening 2.

The end of the sealing film 3 moves with the movable member 60 toward the opening 2 so that the sealing film 3 is drawn with the returning movement of the covering member 4 to close the opening. When the movable member 60 has reached the closed position, or in other words, when the opening 2 has been fully closed by the covering member 4, the sealing film 3 is returned to the original position where the opening 2 is fully covered with the sealing film 3. Also, the covering member 50 returns to the original position (of FIG. 6) where the toner-receiving opening is completely covered with the covering member 50. In this condition, the toner cartridge may be removed from the toner box 5. Any toner remaining within the toner cartridge will not scatter because the opening 2 of the toner cartridge is closed by the sealing film 3 and covering member 4.

As described above, in this embodiment, when the opening and closing operation mechanism of the opening 2 of the toner cartridge is provided in the covering member 50, the movable member 60 is used. The box-side covering member 50 is worked into a predetermined form, and the films 63 are used.

Figure 9:
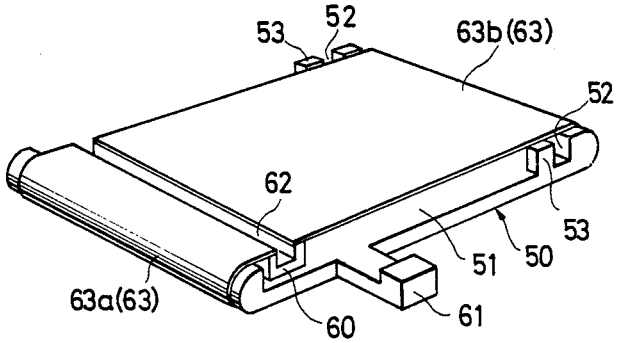
FIG. 9 is a perspective view showing a second embodiment of the opening and closing operation mechanism of the toner cartridge according to the present invention.
Figure 10:
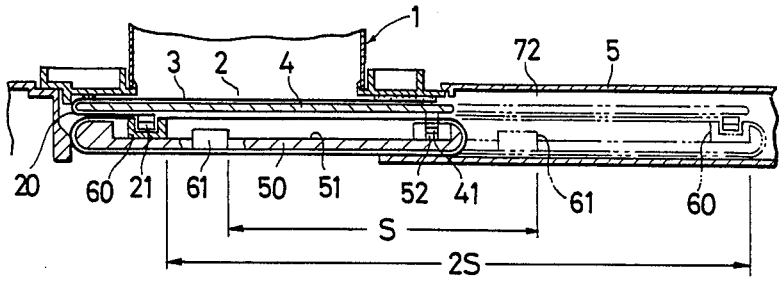
FIG. 10 is a sectional view illustrating the operation of the mechanism of FIG. 9.

A second embodiment is similar in basic construction to the first embodiment, except that the operation knob 61 in this embodiment 2 is provided integrally with the box-side covering member 50 as shown in FIG. 9. When the operation knob 61 is moved by a stroke S corresponding to the length of the opening 2, the movable member 60 follows the box-side covering member 50 and moves a distance 25. The sealing film 3 and the covering member 4 move with the movement of the movable member 60, to open and close the opening 2 of the toner cartridge. Accordingly, the stroke length required for the opening and closing operation can be shortened compared with the first embodiment, so that the opening and closing operation of the opening 2 of the toner cartridge can be simplified.

In this second embodiment, when the operation knob 61 is operated to open the opening 2 of the toner cartridge, the operational force may become heavy according to the influence of some degree of hypertonic force produced on the films 63 by friction between the box-side covering member 50 and the films 63. However, the films 63 can be loosely mounted to the box-side covering member 50 because the films 63 are not for the purpose of sealing. Accordingly, the operational force can be lightened greatly, so that the problem in operational force is easily solved.

Figure 11:
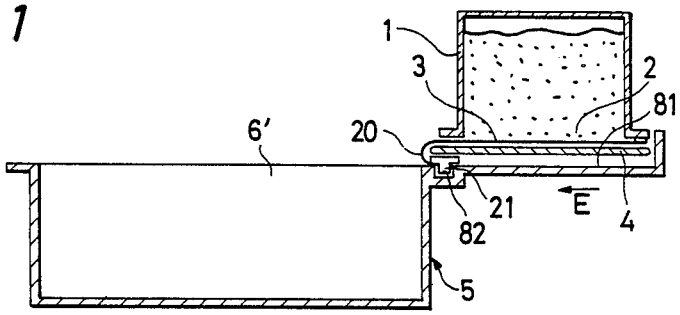
FIG. 11 is a perspective view showing a third embodiment of the opening and closing operation mechanism of the toner cartridge according to the present invention.

A third embodiment of the present invention is shown in FIG. 11 and is similar in basic construction to the first embodiment except that the toner box 5 of the third embodiment is different in construction and the toner supply operation differs from that of first embodiment.

In the third embodiment, a toner-receiving opening 6' having a size about double the length of the opening 2 of the toner cartridge 1 is provided in the toner box 5. Further, a container setting portion 81 is provided longitudinally adjacent to the toner-receiving opening 6' for the purpose of positioning and setting the cartridge container 1. The container setting portion 81 is provided with a stopping/engaged groove 82 for receiving the stopping/engagement projecting-bar member 21 provided at the end of the bent extension 20 of the sealing film 3. Further, the edge of the toner-receiving opening 6' supports the toner cartridge so that the cartridge container is movable along the longitudinal direction thereof. Further, the container setting portion 81 is provided with means (not shown) for pressing the covering member 4 slightly to the bent extension 20 of the sealing film 3.

Figure 12:
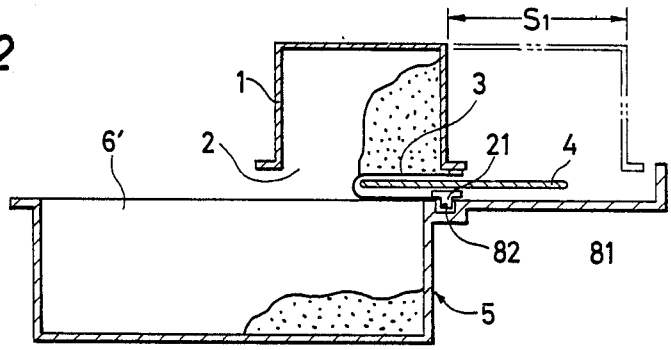
FIGS. 12 and 13 are sectional views illustrating the operation process of the third embodiment of the present invention shown in FIG. 11.
Figure 13:
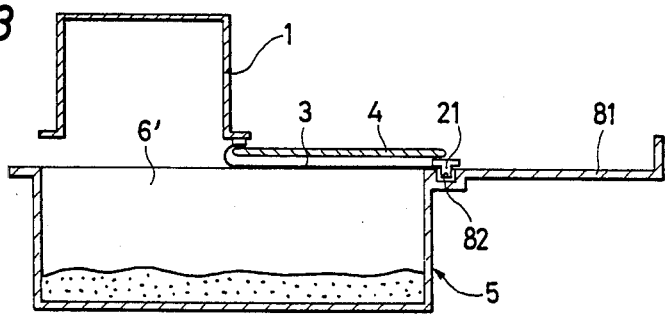
Figure 14:
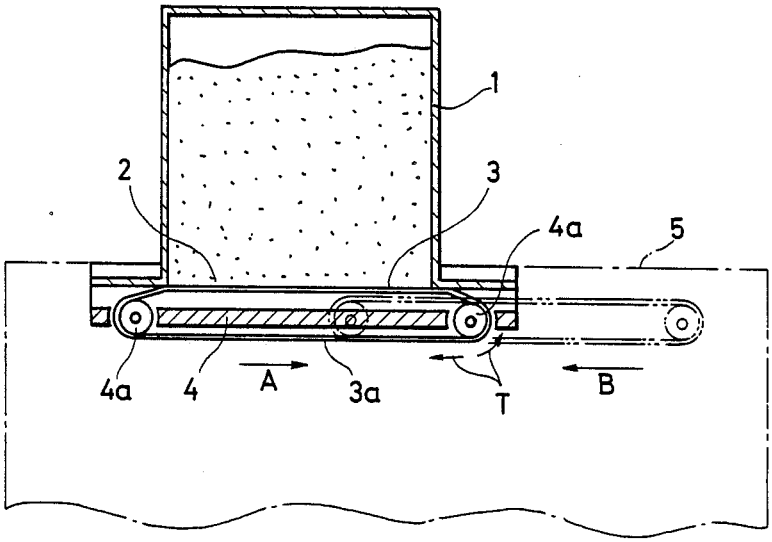
FIG. 14 is a sectional view showing an example of the conventional toner cartridge.

According to the third embodiment, when toner is to be supplied into the toner box 5 from the toner cartridge, as shown in FIG. 11, the toner cartridge is mounted on the container setting portion 81 and then the cartridge container 1 is moved along the toner-receiving opening 6'. When the toner cartridge has been mounted on the container setting portion 81, the stopping/engagement projecting-bar member 21 at the end of the bent extension 20 is fixedly fitted to the stopping-/engaged groove 82. The covering member 4 is slightly urged in the direction of the arrow E by urging means not shown. In this condition, when the cartridge container 1 is moved toward the toner-receiving opening 6' as shown in FIG. 12, the sealing film 3 moves relatively in the peeling-off direction with respect to the stopping-/engagement projecting-bar member 21 and, at the same time, the covering member 4 is moved with the movement of the sealing film 3 in the opening direction of the opening 2 against the urging force of the urging means. In the aforementioned procedure, the opening 2 is opened by half the stroke S1 of the cartridge container 1. Accordingly, as shown in FIG. 13, when the cartridge container 1 moves over the whole area of the toner-receiving opening 6', the opening 2 is fully opened. During the aforementioned procedure, toner is successively supplied into the toner box 5 from the cartridge container 1 through the opening 2. Consequently, the toner is uniformly supplied within a range corresponding to the size of the toner-receiving opening 6' which is about double the size of the opening 2.

On the other hand, when the toner cartridge is to be removed from the toner box 5, the cartridge container 1 disposed at the one end of the toner-receiving opening 6' is returned toward the container setting portion 81 and the toner cartridge is removed from the toner box 5. The opening 2 is lastly securely blocked by the sealing film 3 which moves with the covering member 4 urged by the urging means during the return process of the cartridge container 1. Thus, there is no possibility of toner scattering from the opening 2 when the toner cartridge is removed.

As described above, according to the toner cartridge of the present invention, the opening of the cartridge container can be opened and closed at the point of time when the toner cartridge is mounted in an inverted position on the toner box. Accordingly, the toner cartridge has a basic effect that environmental pollution due to the scattering of toner can be prevented. In addition, according to the present invention, the operational force at the start point of peeling the sealing film for sealing the opening of the cartridge container can be reduced without complicating the constituent members of the toner cartridge. Accordingly, the opening and closing operation of the opening of the cartridge container can be easily made while the requirement of low production cost is also satisfied.

What is claimed is:

1. A disposable toner supply cartridge to be detachably mounted over a toner-receiving opening of a toner box comprising:

a cartridge container for holding the toner, said cartridge container having a bottom opening;

a sealing film for sealing said bottom opening formed in the bottom of said cartridge container, said sealing film being adapted to be peeled off from said bottom opening; and a covering member attached to said cartridge container beneath said sealing film, said covering member being slidable in a first direction corresponding to the direction in which said sealing film is to be peeled off from said bottom opening, said sealing film having a first end fixedly attached to an edge portion of said bottom opening and a second end integrally provided with a bent extension covering at least one end of said covering member such that sliding of said covering member in said first direction moves said bent extension of said sealing film in said first direction to cause said sealing film to be peeled from the bottom of said cartridge container to expose said bottom opening of said cartridge container.

2. A toner cartridge according to claim 1, further including a first adhesive portion along said first edge portion of said bottom opening of said cartridge container for fixedly attaching said first end of said sealing film and second adhesive portions along the remainder of the periphery of said bottom opening of said cartridge container to removably attach said sealing film to said cartridge container, said sealing film being peeled away from said second adhesive portions upon movement of said covering member in said first direction.

3. A toner cartridge according to claim 1, wherein said bent extension of said sealing film includes a portion extending partially along a bottom surface of said covering member.

4. A toner cartridge according to claim 1, wherein said bent extension of said sealing film is substantially U-shaped.

5. A toner cartridge according to claim 1, wherein said toner cartridge is adapted to be used in combination with a toner box having a toner-receiving opening, said toner-receiving opening being substantially twice the size of said bottom opening of said cartridge container, said toner box including a cartridge setting portion provided longitudinally adjacent to said toner-receiving opening for supporting said cartridge container thereon, said cartridge setting portion including a sealing film stop for receiving said second end of said sealing film, said cartridge container being adaptable to slide on said toner box in the longitudinal direction of said toner-receiving opening to cause said sealing film to be peeled off from said bottom opening of said cartridge container to enable toner in said cartridge container to pass through said bottom opening and said toner-receiving opening into said toner box.

6. A toner supply system comprising:

a toner box for receiving toner, said toner box having a toner receiving opening and a supporting portion therearound;

a cover means slidable on said supporting portion between a first position where said cover means covers said toner receiving opening and a second position where said cover is longitudinally displaced from said toner receiving opening, said cover means including a slot and actuator means for sliding said cover between said first and second positions;

a cartridge container for holding toner, said cartridge container having a bottom opening;

a sealing film for sealing said bottom opening formed in the bottom of said cartridge container, said sealing film being adapted to be peeled off from said bottom opening; and a covering member attached to said cartridge container beneath said sealing film, said covering member being slidable in said first direction corresponding to the direction in which said sealing film is to be peeled off from said bottom opening and second direction, said sealing film having a first end fixedly attached to an edge portion of said bottom opening and a second end integrally provided with a bent extension covering at least one end of said covering member, said sealing film including an attaching member at said second end, said attaching member adapted to be received in said slot such that movement of said actuator means in said first direction moves said bent extension in said first direction to peel said sealing film off from said bottom opening and movement of said actuator means in said second direction moves said bent extension in said second direction to cover said opening with said sealing film.

7. A toner cartridge according to claim 6, further including a first adhesive portion along said first edge portion of said bottom opening of said cartridge container for fixedly attaching said first end of said sealing film and second adhesive portions along the remainder of the periphery of said bottom opening of said cartridge container to removably attach said sealing film to said cartridge container, said sealing film being peeled away from said second adhesive portions upon movement of said actuator means in said first direction.

8. A toner cartridge according to claim 6, wherein said bent extension of said sealing film includes a portion extending partially along a bottom surface of said covering member.

9. A toner cartridge according to claim 6, wherein said bent extension of said sealing film is substantially U-shaped.

* * * * *